US009144317B2

(12) United States Patent
Yang

(10) Patent No.: US 9,144,317 B2
(45) Date of Patent: Sep. 29, 2015

(54) FUNCTIONAL CHAIR

(71) Applicant: Jeragene Korea Co., Ltd., Jeju-si (KR)

(72) Inventor: Moon Seok Yang, Seoul (KR)

(73) Assignee: JERAGENE KOREA CO., LTD., Jeju (KR)

( * ) Notice: Subject to any disclaimer, the term of this patent is extended or adjusted under 35 U.S.C. 154(b) by 0 days.

(21) Appl. No.: 14/355,274

(22) PCT Filed: Mar. 15, 2013

(86) PCT No.: PCT/KR2013/002099

§ 371 (c)(1),
(2) Date: Apr. 30, 2014

(87) PCT Pub. No.: WO2013/137679

PCT Pub. Date: Sep. 19, 2013

(65) Prior Publication Data

US 2014/0246891 A1 Sep. 4, 2014

(30) Foreign Application Priority Data

Mar. 16, 2012 (KR) ..... 10-2012-0026844

(51) Int. Cl.

| | |
|---|---|
| ***A47C 7/46*** | (2006.01) |
| ***A47C 9/00*** | (2006.01) |
| ***A47C 7/40*** | (2006.01) |
| ***A47C 7/54*** | (2006.01) |
| *A61H 15/00* | (2006.01) |

(52) U.S. Cl.

CPC . *A47C 9/002* (2013.01); *A47C 7/40* (2013.01); *A47C 7/462* (2013.01); *A47C 7/54* (2013.01); *A61H 2015/0028* (2013.01); *A61H 2015/0057* (2013.01); *A61H 2201/0149* (2013.01); *A61H 2201/1253* (2013.01); *A61H 2201/1676* (2013.01); *A61H 2205/081* (2013.01)

(58) Field of Classification Search

CPC ..... A47C 9/002; A47C 7/462; A47C 7/405
USPC ..... 297/284.3; 601/98, 99
See application file for complete search history.

(56) References Cited

U.S. PATENT DOCUMENTS 5,240,308 A * 8/1993 Goldstein et al. ..... 297/284.3
6,609,754 B2 * 8/2003 Rajasingham ..... 297/284.3

FOREIGN PATENT DOCUMENTS

JP 2003-116950 A 4/2003
JP 2004-261356 A 9/2004

(Continued)

*Primary Examiner* — Anthony D Barfield
(74) *Attorney, Agent, or Firm* — Patent Office of Dr. Chung Park

(57) ABSTRACT

The functional chair includes a backrest support, a backrest, a rotation axis, two rotation plates, an operation rod, a massage roller, and an armrest. The backrest is fixed to the backrest support and has a plurality of operation holes perforated at both sides of the front surface in a zigzag pattern, the rotation axis is fixed to a center of the rear surface of the backrest. The two rotation plates have multiple finger-like extensions formed at horizontally the same location as the operation holes and face while not interfering with each other so as to allow each of the finger-like extensions to rotate on the rotation axis through a rotation sleeve. The operation rod is fixed to the opposite side of each finger-like extension on each of the rotation sleeves and emerges to the front direction of the backrest through each operation hole when each rotation plate rotates.

5 Claims, 7 Drawing Sheets

(56) References Cited

FOREIGN PATENT DOCUMENTS

| | | | | |
|---|---|---|---|---|
| JP | 2011004925 | A | * | 1/2011 |
| KR | 10-2009-0067459 | A | | 6/2009 |
| KR | 10-1003756 | B1 | | 12/2010 |
| KR | 10 1384199 | B1 | * | 5/2014 |

* cited by examiner

FUNCTIONAL CHAIR

CROSS-REFERENCE TO PRIOR APPLICATIONS

This application is a national Stage Patent Application of PCT International Patent Application No. PCT/KR2013/002099, filed on Mar. 15, 2013 under 35 U.S.C. §371, which claims priority of Korean Patent Application No. 10-2012-0026844, filed on Mar. 16, 2012, which are all hereby incorporated by reference in their entirety.

TECHNICAL FIELD

The following disclosure relates to a functional chair, and in particular, to a functional chair that allows a user to use as an ordinary chair, and that by a simple manipulation can not only massage the area around a user's spine to relieve fatigue but can also gather the spine area inwards so as to correct the spine.

BACKGROUND ART

Generally, chairs are being used as a required necessity for human life for a long time. Also, time to use a chair increases as society is modernizing. Accordingly, the shape and kind of chairs are also being developed in various ways according to the purpose and place of the use.

Recently, a chair with a backrest formed into two divided parts is suggested and being widely used to prevent and correct spinal deformity. In addition, chairs that massage or acupressure shoulders and spinal areas by disposing an electric motor on the inner side of the backrest and operating a massage member by the electric motor are being variously suggested.

However, a typical chair for spinal correction is equipped with a backrest merely divided into two parts, but unable to implement an additional acupressure or massage function. A typical electric motor massage chair is not only expensive but also requiring a separate power. Accordingly, there is a limitation in that the chair could not be used regardless of place.

Taking the limitation into consideration, a chair is disclosed in Korean Patent No. 10-0981318 own by the present applicant. The chair includes a backrest comprising two parts each disposed separately rotatable and formed with a massage piece such that the chair can massage a user with the massage piece being in contact with the user's back when the user pushes back the backrest. Since the chair is very complex in structure and performs massage in response to physical movement of a user, massaging area was very limited. Particularly, there is a limitation in that the chair could not be used as an ordinary chair at usual time but used merely for massage.

Taking the limitation into consideration, a "chair having two piece back panel with massager" is disclosed in Korean Patent No. 10-1003756. The chair includes two support members concentrically rotating between two backrests rotatably fixed on a separate pivot axis and massagers configured to massage a user's back and spinal area when stopping protrusions formed on each backrest and each support member rotate in engagement with each other in compliance with a user's motion to fold the backrests back.

However, a chair having two piece back panel with massager according to the embodiment of Patent No. 10-1003756 is also very complex in structure. The chair has a limitation in that a user has to push back his/her back and arm area in a big motion for spinal and back massages. There is a possibility that a user suffers a pain and an injury when his/her clothes or skin gets caught between stopping protrusions during the engaged rotation of a backrest stopping protrusions and a support member's protrusions. Even though the chair has some massaging effect since each protrusion massages from the center of spine toward outer side complying with pushing back action on each backrest by the user, the chair does not perform corrective action to gather spinal area to the center.

DISCLOSURE

Technical Problem

The present invention provides a functional chair, which allows a user to use as an ordinary chair, but which by a simple manipulation not only can massage the area around the spine to relieve fatigue but also can gather the spinal area inwards so as to correct the spine.

Technical Solution

Other features and aspects will be apparent from the following detailed description, the drawings, and the claims.

To solve the problem, the present invention includes a backrest support coupled to the rear of a chair seat board and extending in upward direction; a backrest fixed to the backrest support and having a plurality of operation holes perforated at both sides of the front in a zigzag pattern; a rotation axis fixed to the center of the rear surface of the backrest; two rotation plates having a plurality of finger-like extensions formed at horizontally the same location as the operation hole and facing while not interfering with each other so as to allow each of the finger-like extensions to rotate on the rotation axis through a rotation sleeve; an operation rod fixed to the opposite side of each finger-like extension on each of the rotation sleeves and emerging in the front direction of the backrest through each operation hole when each rotation plate rotates; a massage roller rotatably fixed to the operation rod; an armrest fixed to the side surface of the rotation plate and emerging the massage roller to the front side of the backrest according to an operation to spread to opposite sides from each other.

An elastic member may be interposed between the rotation axis and the rotation sleeve for returning the rotation plate to the original location.

A fitting hole may be formed on each rotation plate for the armrest to fit in. A locking ball may be elastically disposed by an elastic member inside the fitting hole. A fitting protrusion, which has a plurality of locking holes formed at a uniform interval so as to allow the locking balls to be locked into the locking holes, may be formed at a location corresponding to the rotation plate on the armrest. Therefore, a width between the two armrests may be configured to be adjusted according to a user's physique.

The operation holes and the operation rod each may be configured to be gradually shorter from a central portion of the backrest in an upward or downward direction.

The massage roller may be formed to be one selected from the group consisting of jade, phosphate rock, ocher plastic material, ceramic plastic material, crystals containing tourmaline powder, and crystal containing chitosan powder.

Advantageous Effects

Since the massage rollers do not emerge to the outside of the backrest in a state of being received in the operation hole at usual times, present invention can be used as an ordinary chair. When a user merely stretches out the armrests with hands, he/she can get massage on the back and spinal areas.

The rotation plates with the armrests fixed thereof rotate on the rotation axis, rotating the operation rod disposed on the opposite side of the rotation plate to the direction opposite to the rotating direction of the rotation plate, and the massage rollers emerge through the operation holes to roll toward the outer side.

The massage rollers are rotatably fixed to the operation rod to offer a user natural massaging effect being in rolling contact with the back area of a user during the massage. Since the massage rollers in the middle are more protruding than other adjacent massage rollers in the upper and lower directions, the chair is more efficient in massaging curved back and spinal area.

Also, since the two armrests can be adjusted in width according to a user's body type, anyone can use the chair regardless of the user's physique. There is an advantage in that when the two armrests are stretched outward, each massage roller rotates relatively in inward motion, thus massaging the user's back or spinal area inward for correcting the user's deformed spine.

BEST MODE

Figure 1:
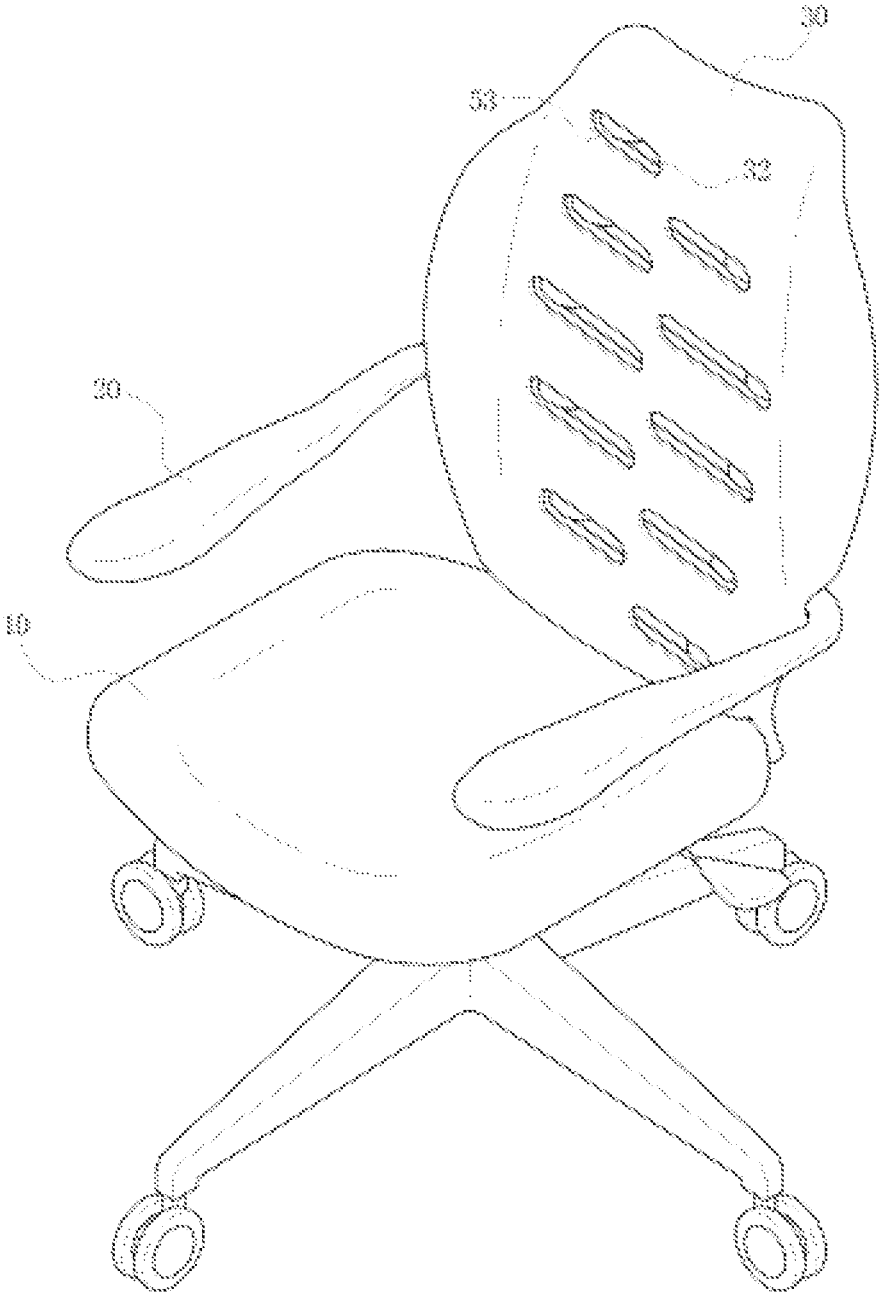
FIG. 1 is a perspective view illustrating a functional chair according to an embodiment of the present invention.
Figure 2:
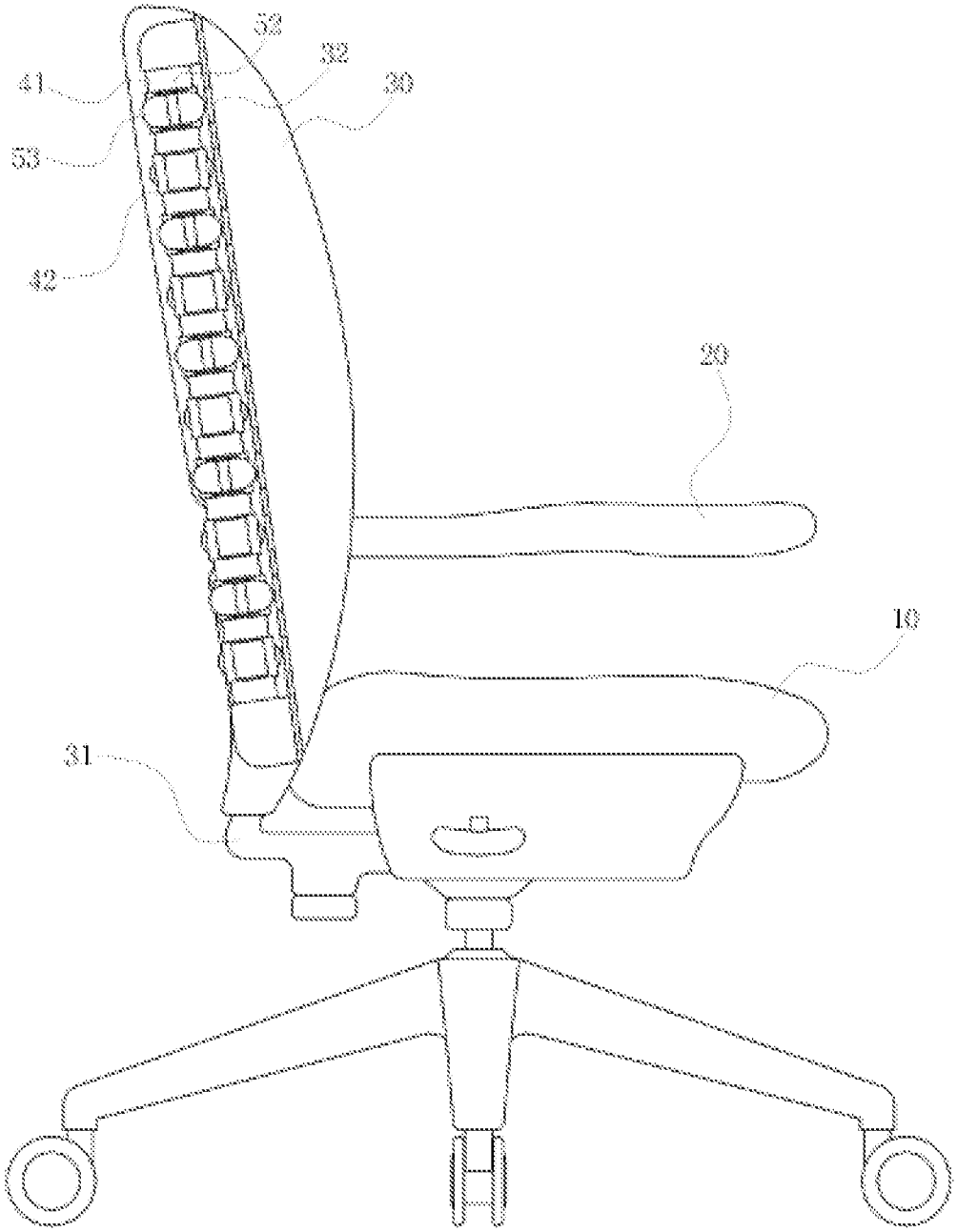
FIG. 2 is a cross-sectional side view illustrating a functional chair according to an embodiment of the present invention.
Figure 3:
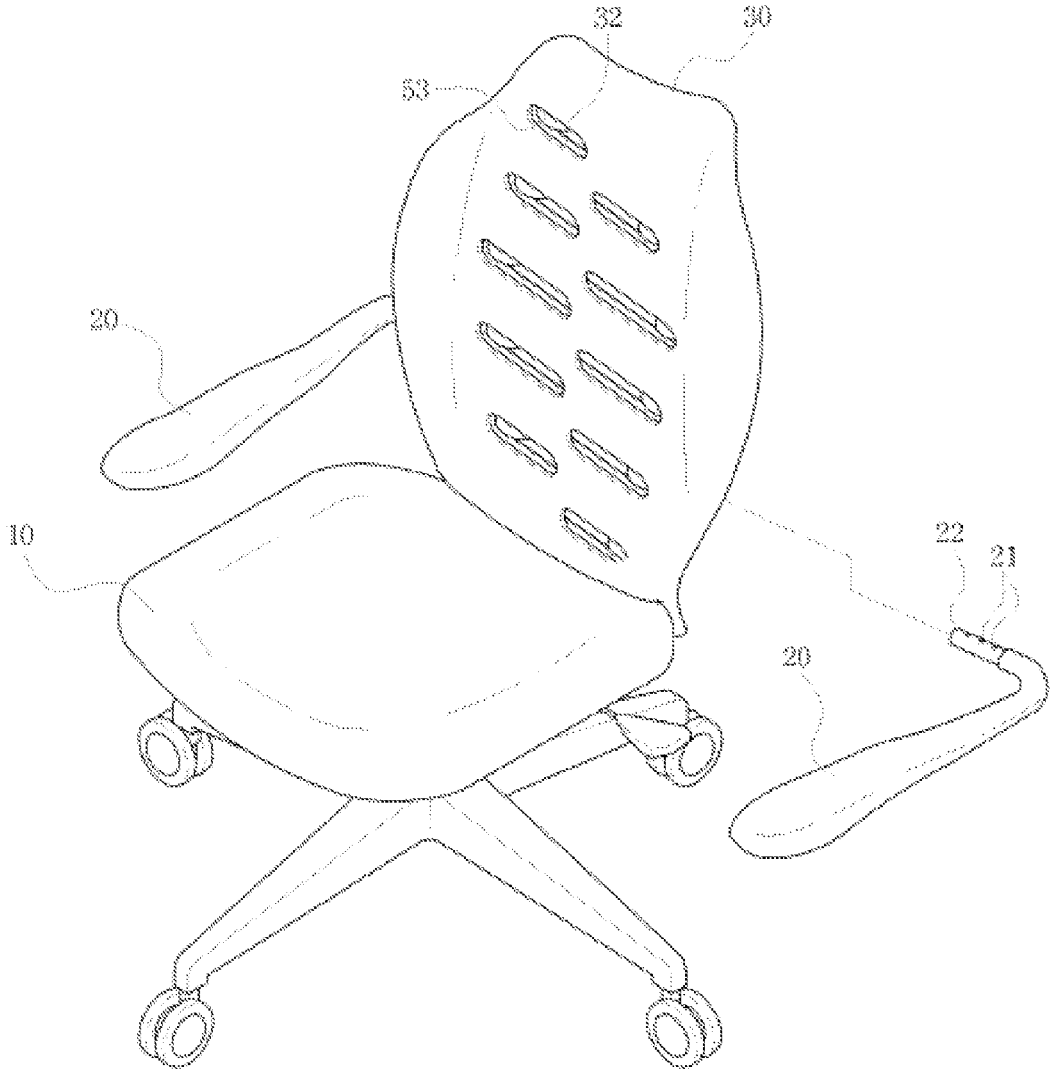
FIG. 3 is an exploded perspective view illustrating a functional chair according to an embodiment of the present invention.
Figure 4:
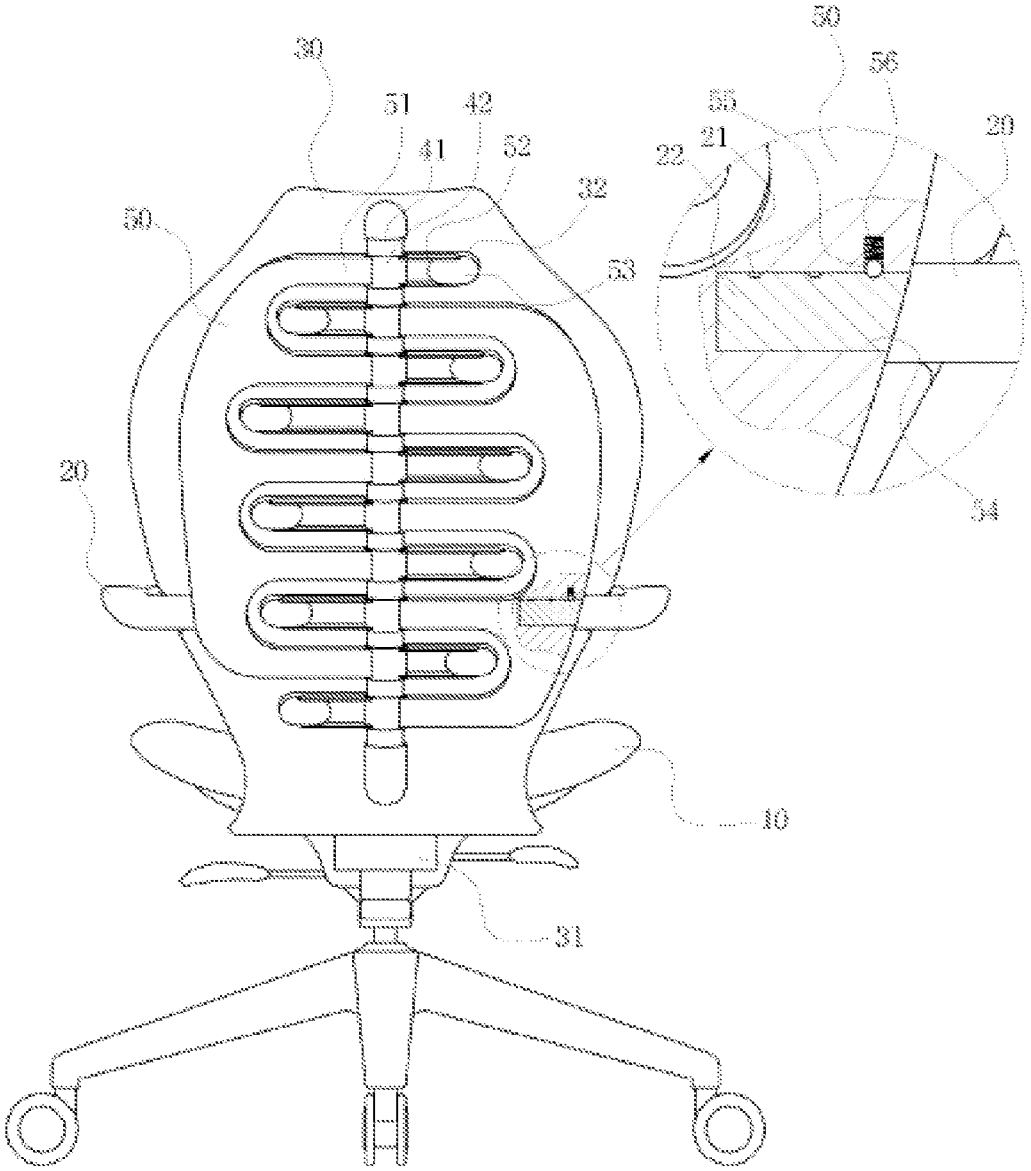
FIG. 4 is a rear view illustrating a functional chair according to an embodiment of the present invention.
Figure 5:
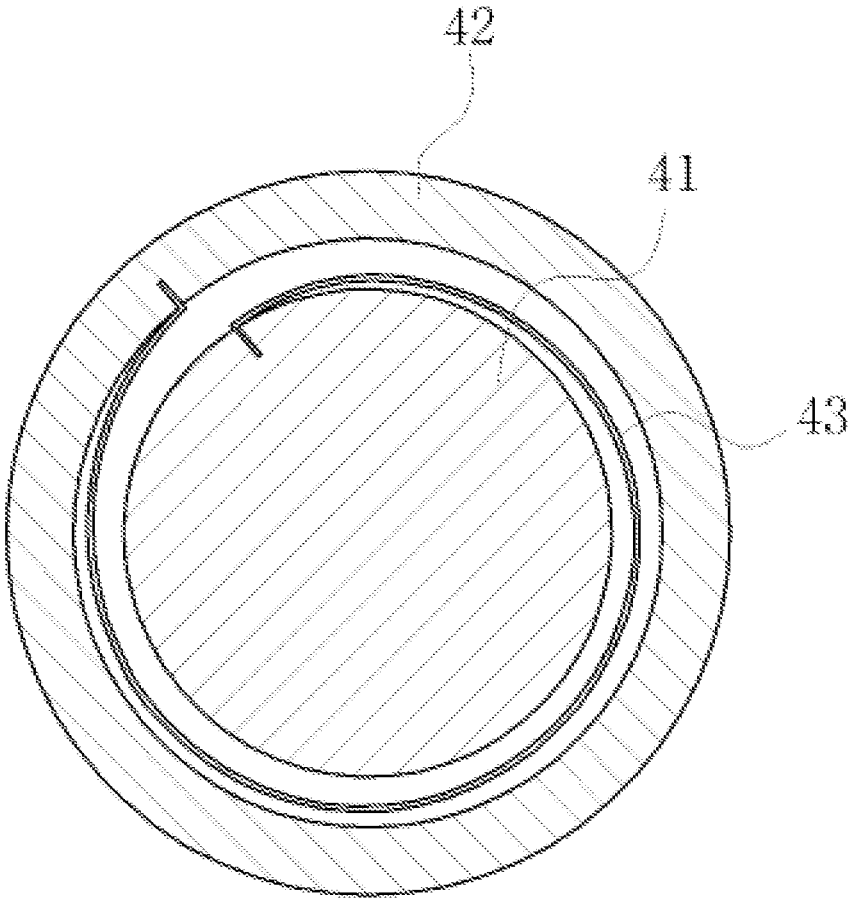
FIG. 5 is a cross-sectional view illustrating a rotation axis part according to an embodiment of the present invention.
Figure 6:
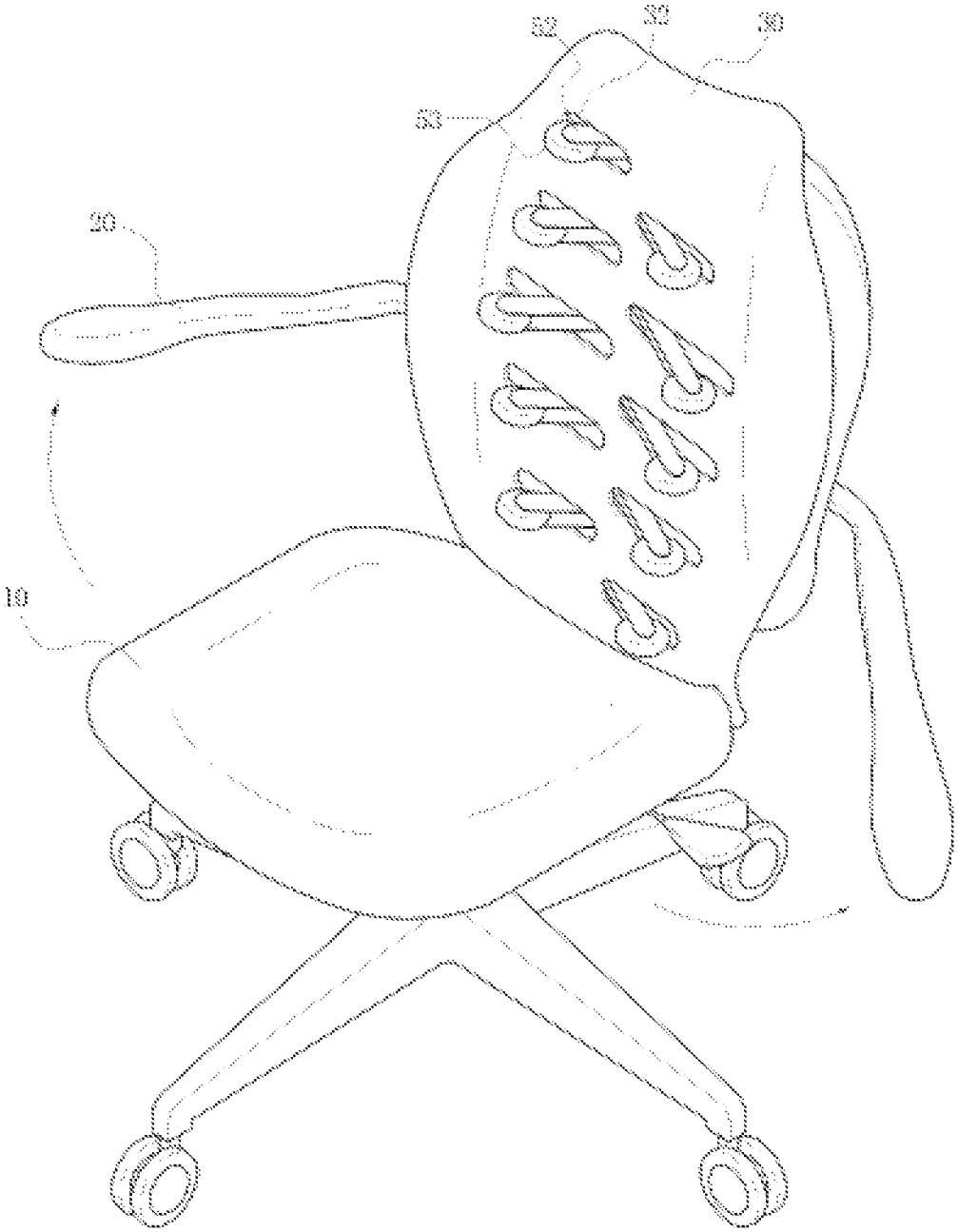
FIG. 6 is a perspective view illustrating a functional chair in operation according to an embodiment of the present invention.
Figure 7:
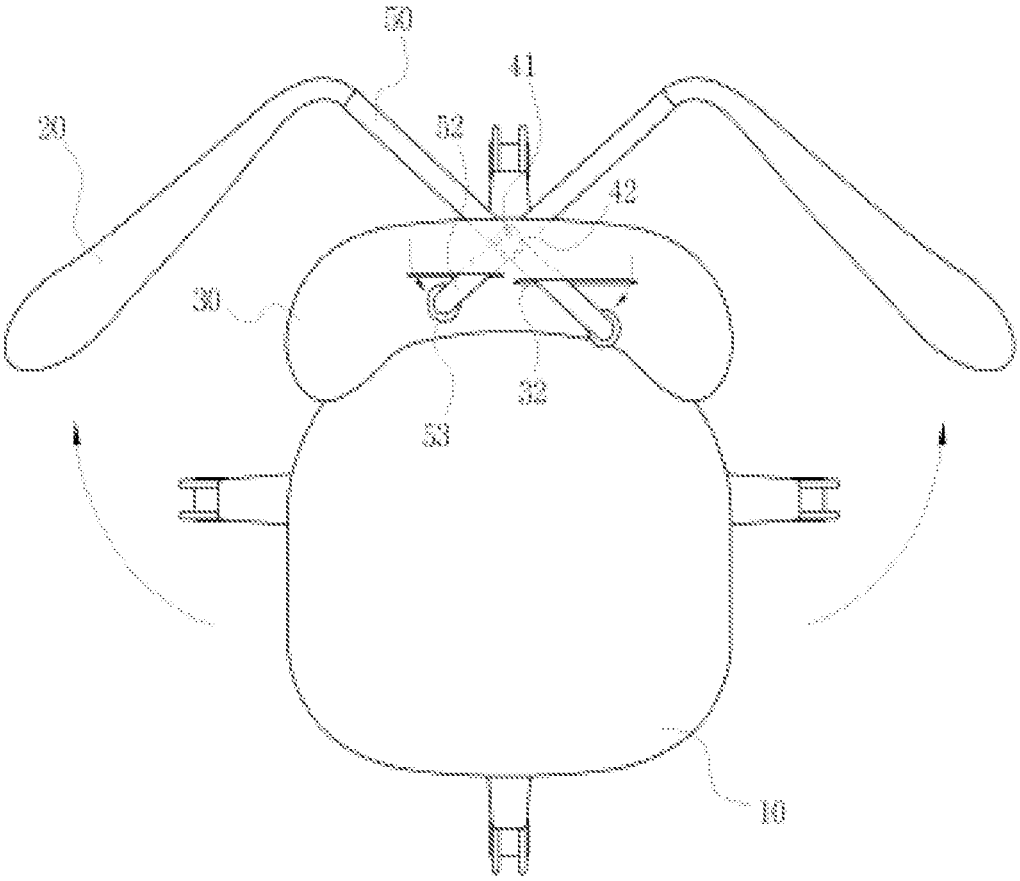
FIG. 7 is a plan view illustrating a functional chair in operation according to an embodiment of the present invention.

Hereinafter, exemplary embodiments will be described in detail with reference to the accompanying drawings. Throughout the drawings and the detailed description, unless otherwise described, the same drawing reference numerals will be understood to refer to the same elements, features, and structures. The relative size and depiction of these elements may be exaggerated for clarity, illustration, and convenience. The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness.

In an embodiment of the present invention, when armrests 20 of the chair are stretched outward, massage rollers 53 may emerge to the front side direction of a backrest 30 such that a massage on back and spinal area can be conducted. The embodiment of the present invention may be applied to any type of chair equipped with a seat board 10, armrests 20 and a backrest 30.

In the chair, a backrest support 31 may be coupled to the rear side of the seat board 10 and extended to be formed in upward direction and the backrest 30 may be fixed to the backrest support 31.

A plurality of operation holes 32 may be perforated on both sides of the backrest 30 front in a zigzag array. Massage rollers 53, to be described later, may emerge through the operation holes 32.

A rotation axis 41 may be fixed to the center of the back side of the backrest 30. A plurality of rotation sleeves 42 may be fit on the rotation axis 41 to rotate level with the operation holes 32. Two rotation plates 50 may be disposed on both sides of the rotation axis 41 one each side.

Two rotation plates 50 may have a plurality of finger-like extensions 51 formed thereon, facing each other, level with each operation hole 32 on the backrest 30 and facing but not interfering with each other. Each finger-like extension 51 may be fixed to each rotation sleeve 42 such that the rotation plate can rotate on the rotation axis 41. An operation rod 52 fixed to the opposite side of each finger-like extension on each of the rotation sleeves 42, may emerge by a relative action to the front direction of the backrest 30 through each operation hole 32 when each rotation plate 50 rotates. A massage roller 53 may be rotatably fixed to each operation rod 52.

The operation rod 52 located on the upper part and lower part of the massage roller 53, may support the massage roller 53 to rotate on an axis. Even though not illustrated in detail, bearings may be disposed on the axis of the massage roller 53.

Also, the massage roller 53 may be formed of one selected from the group consisting of jade, phosphate rock, ocher plastic material, ceramic plastic material, crystals containing tourmaline powder, and crystal containing chitosan powder so as to emit far infrared rays or negative ions and activate bodily functions by a mere contact with the body in addition to a massaging effect.

An armrest 20 may be inserted to be fixed on the side of each rotation plate 50 so as to be rotted. A fitting hole 54 is formed on each rotation plate 50 for adjusting a width between the two armrests according to a user's physique. For this, a fitting hole 54 may be formed on each rotation plate 50 for the armrest 20 to fit in. A locking ball 55 may be elastically disposed by a compressed coil spring 56 inside the fitting hole 54. A fitting protrusion 22 having a plurality of locking holes 21 formed at a uniform interval thereon to allow the locking ball 55 locked in the locking holes, may be formed at a location corresponding to the rotation plate on the armrest 20 such that a width between the two armrests is adjusted according to a user's physique.

Also, an elastic member 43 like a returning spring may be interposed between the rotation axis 41 and the rotation sleeve 42 to allow the rotation plate 50 to return to its original location such that each rotation plate 40 and armrest 20 can automatically return to its original location when a force imposed on the armrest 20 to rotate each rotation plate 50 is removed with each rotation plate 50 in a rotated state. Such elastic member 43 may be interposed between all the rotation sleeves 42 and the rotation axis 41, or between a few selected rotation sleeves 42 and the rotation axis 41.

Also, back and spinal area of a human body is generally shaped concave and rounded in the middle compared to other parts. Considering this, each operation hole 32 and operation rod 52 may be formed to be shorter more to the upper direction or lower direction from the central part.

In such configuration, under no external force imposed each rotation plate 50 and each armrest 20 may be maintained in an original state by the elastic member 43, and the massage roller 53 may not be emerged in a received state inside each operation hole 32. The chair may be used as an ordinary chair.

When a user merely spreads out both armrests 20 with hands, he/she can get massage on the back and spinal areas. Since the armrests 20 are fixed to the rotation plates 50, when the armrests 20 spread out, each rotation plate 50 may rotate on the rotation axis 41 at the same time. The operation rod 52 may be fixed on the opposite side of the rotation sleeve 42 from the finger-like extension 51 of the rotation plate 50. Accordingly, the operation rod 52 may be rotated to the opposite direction of the rotation plate's 50 rotation and emerge to the front surface direction of each operation hole 32, The massage roller rotatably connected to the free end part of each operation rod 52 may emerge through each operation hole to emerge to forward direction.

Each massage roller 53 emerging through each operation hole 32 of backrest 30 to the front direction may touch the user's back and spinal areas, thus giving massage to the user, who is seated in the chair. The massage rollers 53 are rotatably fixed to each operation rod 52, to keep in rolling contact with a user's back area, offering a natural massaging effect.

Massage rollers 53 in the middle are more protruding than other adjacent massage rollers 53 in the upper and lower direction, the chair is more efficient in massaging back and spinal area that are more concave and curved in the middle than other parts.

In this case, with an elastic member 43 like a returning spring interposed between the rotation sleeve 42 and the rotation axis 41 when a user removes the force imposed on an armrest 20, the rotation plate 50 and the armrest 20 may be returned to the original locations by the elastic member 43 and so may the massage rollers 53. Therefore, the user may give himself/herself appropriate massages on the back and spinal areas under his/her own adjustment control by repeating the motion of imposing and removing a force on the armrest 20.

Also, since when the user stretches each armrest 20 outward, each massage roller 53 rotates relatively in inward motion, thus massaging the user's back or spinal area toward the center from outer side, the user may also have an advantage of naturally correcting the spine that may be a little out of alignment by the repetition of the motion.

Also, since the massage roller is configured to be one selected from among the group of jade, phosphate rock, ocher plastic material, ceramic plastic material, crystal containing tourmaline powder, and crystal containing chitosan powder, there may also be an advantage that the massage roller emits far infrared rays or negative ions and activate bodily functions by a mere contact with the body in addition to a massaging effect.

On the other hand, chairs are manufactured to fit a standard male adult while people vary vastly in size. Therefore, a big person cannot use a chair of a general size and has no other way but to purchase a big chair separately. In case of a functional chair, there is also a limitation about its use by a big person.

In the present invention, such limitations are considered in order for a width between the armrests 20 to be adjusted. For this, a fitting hole 54 may be formed on each rotation plate 50 for the armrest 20 to fit in. A locking ball 55 may be disposed elastically by a compressed coil spring 56 inside the fitting hole 54. A fitting protrusion 22, which has a plurality of locking holes 21 formed at a uniform interval so as to allow the locking balls 55 to be locked in the locking holes, may be formed at a location corresponding to the rotation plate on the armrest 20. Then the user may adjust the width between the armrests 20 to fit his/her physical size by selecting a right depth to fit the fitting protrusion 22 of each armrest 20 into each rotation plate 50.

The invention claimed is:

1. A functional chair comprising;

a backrest support coupled to the rear side of a chair seat board and extending in an upward direction;

a backrest fixed to the backrest support and having a plurality of operation holes perforated at both sides of the front surface in a zigzag pattern;

a rotation axis fixed to a center of the rear surface of the backrest;

two rotation plates having a plurality of finger-like extensions formed at horizontally the same location as the operation holes and facing while not interfering with each other so as to allow each of the finger-like extensions to rotate on the rotation axis through a rotation sleeve;

an operation rod fixed to the opposite side of each finger-like extension on each of the rotation sleeves and emerging to the front direction of the backrest through each operation hole when each rotation plate rotates;

a massage roller rotatably fixed to each operation rod; and an armrest fixed to the side surface of each rotation plate and emerging the massage roller to the front side of the backrest according to an operation to spread to opposite sides from each other.

2. The functional chair of claim 1, comprising an elastic member interposed between the rotation axis and the rotation sleeve for returning the rotation plate to the original location.

3. The functional chair of claim 1, wherein:

the rotation plate has a fitting hole which the armrest is inserted into;

a locking ball is elastically disposed by an elastic member inside the fitting hole; and a fitting protrusion, which has a plurality of locking holes formed at an uniform interval so as to allow the locking ball to be locked into the locking hole, is formed at a location corresponding to the rotation plate on each armrest such that a width between the two armrests is adjusted according to a user's physique.

4. The functional chair of claim 1, wherein each of the operation holes and each of the operation rods are configured to become gradually shorter from a central portion of the backrest in an upward or downward direction.

5. The functional chair of claim 1, wherein the massage roller is formed of one selected from the group consisting of jade, phosphate rock, ocher plastic material, ceramic plastic material, crystal containing tourmaline powder, and crystal containing chitosan powder.

* * * * *